United States Patent [19]

Mohrsen

[11] Patent Number: 4,763,822

[45] Date of Patent: Aug. 16, 1988

[54] PAPER TAIL NIP THREADER

[75] Inventor: Leif Mohrsen, Surrey, Canada

[73] Assignee: Fibron Machine Corporation, New Westminster, Canada

[21] Appl. No.: 812,909

[22] Filed: Dec. 23, 1985

[51] Int. Cl.[4] ..... B65H 20/14; G03B 1/56

[52] U.S. Cl. ..... 226/91; 162/286; 226/95

[58] Field of Search ..... 226/7, 12, 91, 92, 95, 226/97; 162/286, 193; 34/120

[56] References Cited

U.S. PATENT DOCUMENTS

| | | | |
|---|---|---|---|
| 3,485,429 | 12/1969 | Hutzenlaub | 226/97 |
| 4,039,256 | 8/1977 | Teeple, Jr. et al. | 226/97 X |
| 4,231,272 | 11/1980 | Crouse | 226/97 X |
| 4,308,984 | 1/1982 | Vits | 226/97 |
| 4,513,517 | 4/1985 | Vedenpaa | 226/97 X |
| 4,593,521 | 6/1986 | Stalder et al. | 226/97 X |

FOREIGN PATENT DOCUMENTS

| | | | |
|---|---|---|---|
| 2462038 | 10/1975 | Fed. Rep. of Germany | 226/91 |

OTHER PUBLICATIONS

Product Manual of Western Tool & Mfg. Co. of Springfield, Ohio, pp. 2 and 5.

*Primary Examiner*—Stanley N. Gilreath
*Assistant Examiner*—Lynn M. Sohacki
*Attorney, Agent, or Firm*—Klarquist, Sparkman, Campbell, Leigh & Whinston

[57] ABSTRACT

A paper tail nip threader for guiding a moving paper tail over and around a contoured surface. The apparatus is particularly useful for automatically threading a paper tail through a calender roll stack.

A guide surface is shaped to conform to a portion of the surface over which the paper is to be passed. An air stream is directed across the guide surface in the desired direction of movement of the paper. The air stream is thus forced to flow in a contoured path which corresponds to the surface over which the paper is to be passed. The moving air stream "catches" the paper tail and carries it between the guide surface and the surface over which the paper is to be passed.

17 Claims, 3 Drawing Sheets

PAPER TAIL NIP THREADER

FIELD OF THE INVENTION

This application pertains to a paper tail nip threader for directing a moving paper tail from point to point within an operating paper machine. More particularly, the application pertains to a paper tail nip threader for automatically threading a moving paper tail through a stack of rotating rolls by guiding the tail from an out-running nip of a pair of counter-rotating rolls, along a desired path (i.e. over and around a roll) and into an in-running nip of another pair of counter-rotating rolls.

BACKGROUND OF THE INVENTION

At various stages of a typical paper making operation a moving, continuous sheet of paper is passed, at high speed, over a plurality of rolls which are rotated with respect to one another. For example, at one stage of the paper making operation the moving paper sheet is passed over a plurality of dryer rolls. Adjacent pairs of dryer rolls are rotated in opposite directions so that the paper is drawn from roll to roll. The roll surfaces are heated to evaporate moisture from the paper. The pressure applied to the moving paper sheet by pressing it against the roll faces also assists in moisture removal. At a subsequent stage of the paper making operation the moving paper sheet is typically passed between adjacent pairs of counter-rotating calender rolls (the "calender stack") which calender the paper by imparting the desired smooth finish thereto, after which the sheet is passed to a reel and onto a wind-up spool.

Since it is difficult to thread a full width moving paper sheet between a pair of counter-rotating rolls, a narrow tail is typically cut to one side of the moving sheet before the paper encounters the counterrotating rolls. The tail can be more easily threaded through the rolls and, once correctly threaded, is used to draw the full width of the paper sheet between the rolls. This method is used to transfer the paper from the last dryer roll through the calender stack, and is also used to transfer the paper from the calender stack to the reel and wind-up spool.

In the prior art, the paper tail threading procedure is typically time consuming and labour intensive. Often, the operating speed of most of the paper making machinery must be reduced so that the paper can be manually handled and guided between adjacent pairs of counter-rotating rolls. Conventionally, workmen use air hoses to direct blasts of air at the paper tail in an effort to force it into the desired position between a pair of in-running rolls, until the tail is caught and pulled through; after which the air hose must be used to direct the paper tail to the next pair of rolls in the sequence. Sometimes, mechanical prods, or hand-held dual rolls are used to force the tail into the desired position between the rolls. Unfortunately, these techniques are not only cumbersome and time-consuming, but also expose the workmen to possible serious injuries if their hands or arms become trapped between the rapidly rotating rolls.

The present invention provides a paper tail nip threader or "guide" for automatically guiding a moving paper tail from point to point within an operating paper machine; for example, over or around a contoured surface such as the surface of a roll. A plurality of such guides may be arranged to guide a moving paper tail at high speed over and between adjacent pairs of counter-rotating rolls, thereby vastly simplifying the tail handling and threading procedure and overcoming the foregoing difficulties by reducing labour costs, while operating the paper making machinery at its maximum speed and minimizing the potential for operator injuries.

SUMMARY OF THE INVENTION

In accordance with the preferred embodiment the invention provides a paper tail guide for guiding a moving paper tail along a desired path; for example, over a contoured surface such as the surface of a rotating roll. The paper tail guide comprises an incurred, external guide surface which is shaped to conform to a single side of a portion of the surface over which the paper is to be passed. An air directing means is provided for directing a low volume air stream across the guide surface at high speed in the desired direction of movement of the paper. The guide surface constrains the moving air stream to flow in a path which corresponds to the shape of the surface over which the paper is to be passed. The paper tail is caught by the moving air stream and carried through a narrow space between the guide surface and the surface over which the paper is to be passed. The paper tail may be ejected from the guide surface at a point close to the in-feed nips of a pair of counter-rotating rolls so that the tail will be caught by the rolls and pulled between them.

The air directing means may comprise an aperture in the guide surface and a deflector for deflecting air passed through the aperture across the guide surface in the desired direction of movement of the paper. Advantageously, a plurality of apertures may be spaced, in the desired direction of movement of the paper, over the guide surface and a deflector associated with each such aperture.

Preferably, the deflectors each comprise a portion of the guide surface so as to avoid obstruction of the moving paper.

The apertures extend across the guide surface in a direction generally perpendicular to the desired direction of movement of the paper.

DETAILED DESCRIPTION OF THE PREFERRED EMBODIMENT

Figure 1:
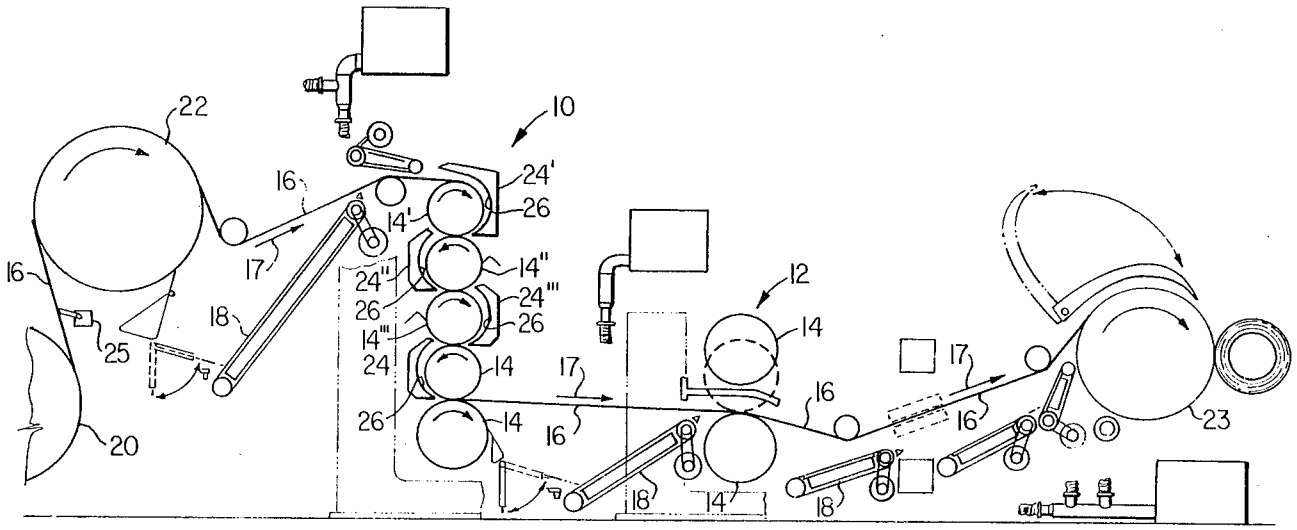
FIG. 1 is a side elevation view which illustrates how a plurality of paper tail nip threaders or "guides" of the preferred embodiment may be positioned relative to a stack of counter-rotating rolls.

FIG. 1 illustrates two pairs of "calender stacks" 10, 12 each of which comprises a plurality of counter-rotating calender rolls 14. A moving, continuous sheet of paper 16 is passed, in the direction of arrows 17 and at high speed, over and between desired pairs of rolls 14 to "calender" the paper by imparting the desired smooth finish thereto. Adjustably positionable vacuum transfer units 18 of the type generally described in U.S. Pat. No. 4,022,366 assist in transfering the paper between dryers 20 and 22, calender stacks 10, 12, and ultimately onto wind-up reel 23.

Since it would be extremely difficult to thread the full width of moving paper sheet 16 through either of calender stacks 10 or 12, a narrow tail is cut to one side of sheet 16 by tail slitter 25, as the sheet passes from dryer 20 to dryer 22. The tail is more easily handled and threaded through stacks 10 and 12 and is then used to draw the full width of sheet 16 through stacks 10 and 12.

Rolls 14 comprising calender stack 10 counterrotate, relative to one another, in the directions indicated by the arrows on each of rolls 14. It can thus be seen that when the paper tail is delivered, from the left, to the top of roll 14', the tail is caught by the rotating roll and pulled over the roll to the right side of calender stack 10. If nothing further were done then when the paper tail passed over to the right side of roll 14', it would tend to fly out to the right of calender stack 10, rather than be carried downward over the rotating surface of roller 14' and between counterrotating rolls 14', 14'' as desired. The moving paper tail must then somehow be threaded downward over the rotating surface of roll 14' and between the infeed nips to the right of roll pair 14', 14''.

This is accomplished by paper tail nip threaders or "guides" 24 which are closely spaced, relative to rolls 14, to guide the paper tail from point to point over and around the rotating roll surfaces. As may be seen in FIG. 1, threaders 24 have contoured incurved, external guide surfaces 26 which are shaped to conform to a portion of the surfaces of rolls 14 over which moving paper sheet 16 is to be passed. If it is desired to pass the paper tail along some reasonably short path other than a path conforming to the shape of a roll, then the shape of contoured surface 26 may be altered accordingly to conform to the shape of the desired path. In any case, surface 26 is made slightly wider than the width of the paper tail to be guided across surface 26.

Figure 2:
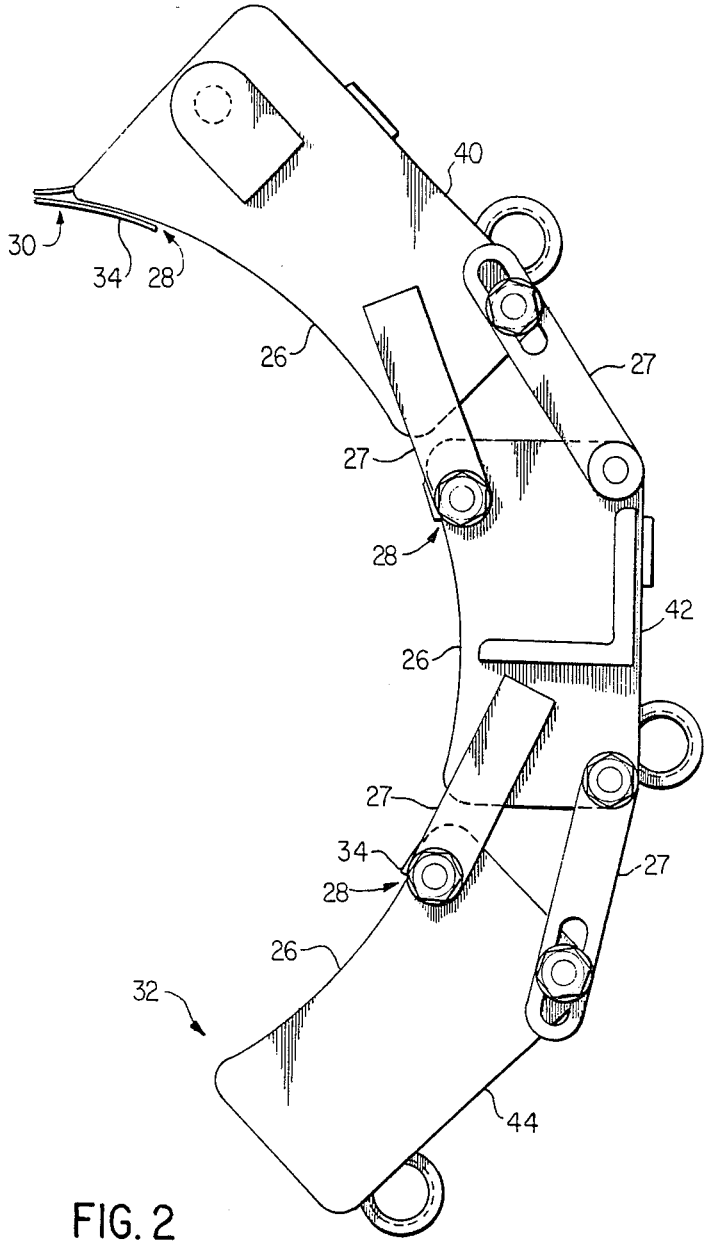
FIG. 2 is a side view of one of the paper tail nip threaders of FIG. 1.

As may be seen in FIG. 2, paper tail nip threader 24 may comprise a plurality of sections such as upper section 40 (shown in greater detail in FIG. 3), central section 42 (shown in greater detail in FIG. 4) and lower section 44. The sections are coupled together with brackets 27, which enable variable positioning of the sections relative to one another, yielding a relatively wide range of possible shapes for guide surface 26.

Figure 3:
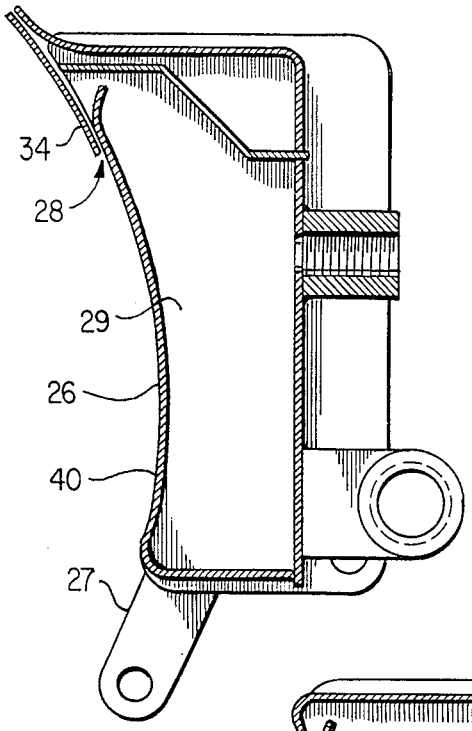
FIGS. 3 and 4 are cross-sectional side views of the upper and central sections, respectively, of the paper tail nip threader of FIG. 2.
Figure 4:
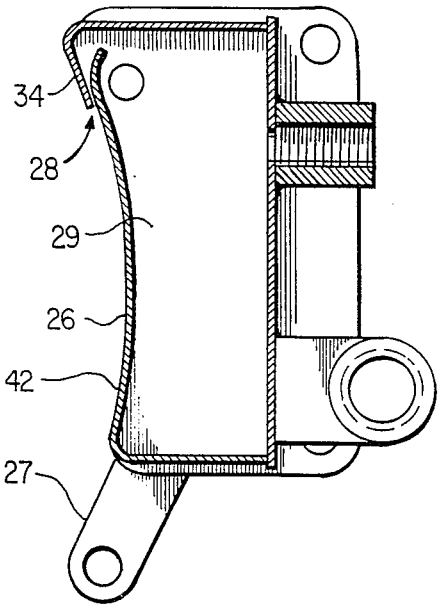

As may be seen in FIGS. 2, 3 and 4, an "air directing means", namely narrow (approximately 0.015 inches measured in the direction of desired movement of the paper tail) slotted aperture 28, is provided in each of said guide surfaces 26. Apertures 28 extend transversely to the desired direction of movement of the paper tail; that is from side to side across guide surface 26 and are spaced from top 30 to bottom 32 of guide surface 26 as shown in FIG. 2 (i.e., the apertures are spaced in the desired direction of paper movement). Preferably, each of narrow slotted apertures 28 comprises a series of longitudinally aligned apertures each measuring about 0.015 inches (in the direction of desired movement of the paper tail) by about 0.375 inches (in the direction transverse to the direction of desired movement of the paper tail), with gaps of about 1.5 inches between adjacent apertures of each series. This lends rigidity to nip threader 24 in the region of apertures 28.

A deflector 34 is associated with each of apertures 28. Deflectors 34 each comprise a portion of guide surface 26, so as to minimize interference with the passage of the paper tail over guide surface 26. Compressed air is injected, at relatively low volume and pressure, into the hollow spaces 29 within the various sections comprising paper tail nip threader 24 and is forced, at high speed, through each of narrow apertures 28. The moving air streams which emerge from apertures 28 are deflected by deflectors 34 and thus constrained to pass across guide surface 26 in the desired direction of movement of the paper tail (i.e. from top 30 to bottom 32 of nip threader 24 as viewed in FIG. 2).

With reference to FIG. 1, it will thus be understood that, for example, when the paper tail emerges from between rolls 14', 14'' to the left of calender stack 10 it passes into the upper region of the space between roller 14'' and paper tail nip threader 24''. The paper tail is urged toward guide surface 26 of nip threader 24'' by the negative pressure created by the moving air stream which is deflected across surface 26 by an aperture 28 and associated deflector 34 positioned across the top of nip threader 24''. The moving air stream carries the paper tail across guide surface 26 and through the narrow contoured gap between surface 26 and roller 14''. Additional (optional) apertures 28 and deflectors 34 may be spaced over guide surface 26, as described above, to maintain a continuous low volume, high velocity air stream across guide surface 26 in the desired direction of movement of the paper tail. The moving paper tail is thus carried to the bottom of paper tail nip threader 24'' and emerges at the infeed nips between and to the left of counter-rotating rolls 14'', 14'''. The paper tail is caught by counter-rotating rolls 14'' and 14''', pulled between those rolls and emerges to their right. Paper tail nip threader 24''' then guides the moving paper tail over the surface of roller 14''' and delivers it to the infeed nips of the next counter-rotating roll pair. The outer edges of nip threader sections 40, 42 and 44 parallel to the desired direction of movement of the paper tail are made flush with guide surfaces 26 of each section. Thus the moving air stream passing between the paper tail and surface 26 may escape over the edges, thereby preventing build-up of air between the paper tail and surface 26 which could interfere with smooth passage of the paper tail over surface 26.

It will thus be understood that by positioning paper tail nip threaders 24 as shown in FIG. 1 relative to counter-rotating rolls 14 the moving paper tail may be automatically threaded through any desired combination of counter-rotating calender rolls 14.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A paper tail threader for a paper processing machine, comprising:

(a) guide means for guiding the movement of a paper tail over a roll in said machine, including, an incurved, external guide surface shaped to conform to a single side of a path along which paper is to be passed; and, (b) air directing means for directing an airstream in a curve along said guide surface in a desired direction of travel of the paper to provide an airstream on only one side of said paper, and for moving said paper tail by said airstream along said guide surface and into engagement with said roll.

2. A paper tail threader as defined in claim 1, wherein said air directing means comprises:

(a) an aperture means for passing air therethrough; and (b) a deflector extending along the incurved surface of the guide for deflecting air passed through said aperture means across said guide surface in said desired direction.

3. A paper tail threader as defined in claim 1, wherein said air directing means comprises:

(a) a plurality of apertures spaced, in said desired direction, over said guide surface; and (b) a deflector associated with each of said apertures for deflecting air passed through said apertures in said desired direction.

4. A paper tail threader as defined in claim 2 wherein said deflector comprises a portion of said guide surface.

5. A papertail threader as defined in claim 3, wherein each of said deflectors comprises a portion of said guide surface.

6. A paper tail threader as defined in claim 2, wherein said aperture means includes a series of apertures spaced across said guide surface in a direction generally perpendicular to said desired direction.

7. A paper tail threader as defined in claim 3, wherein each of said apertures extends across said guide surface in a direction generally perpendicular to said desired direction.

8. A paper tail threader for a paper processing machine, comprising the combination of:

(a) a roll having a surface over which paper is to be passed, and (b) a paper tail guide, said guide including (c) an incurved, external guide surface shaped to conform to one side of a portion of said roll surface; and (d) air directing means for directing an airstream in a curve along said guide surface in a desired direction of movement of said paper to provide an airstream on only one side of said paper, and for moving said paper tail by said airstream along said guide surface and into engagement with the suface of said roll.

9. The combination of claim 8, wherein said air directing means comprises:

(a) an aperture means for passing air therethrough; and, (b) a deflector extending along the incurved surface of the guide for deflecting air passed through said aperture means across said guide surface in said desired direction.

10. The combination of claim 8, wherein said air directing means comprises:

(a) a plurality of apertures spaced, in said desired direction, over said guide surface; and, (b) a deflector associated with each of said apertures, said deflectors for deflecting air passed through said apertures in said desired direction.

11. The combination of claim 9, wherein said deflector comprises a portion of said guide surface.

12. The combination of claim 10, wherein each of said deflectors comprise a portion of said guide surface.

13. The combination of claim 9, wherein said aperture means includes a series of apertures spaced across said guide surface in a direction generally perpendicular to said desired direction.

14. The combination of claim 10, wherein each of said apertures extends across said guide surface in a direction generally perpendicular to said desired direction.

15. A paper tail threader as defined in claim 2, wherein said guide means comprises:

(a) a plurality of sections coupled together by adjustable coupling means for variable positioning of said sections with respect to one another to change the curve of the incurved guide surface and to provide a conformal guide path; and, (b) at least one gap between each of said sections, separate from said aperture means, for the induction of air onto said guide surface.

16. A paper tail threader as defined in claim 9, wherein said guide means comprises:

(a) a plurality of sections coupled together by adjustable coupling means for variable positioning of said sections with respect to one another to change the curve of the incurved guide surface and to provide a conformal guide path; and, (b) at least one gap between each of said sections, separate from said aperture means, for the induction of air onto said guide surface.

17. A paper tail threader in accordance with claim 1 in which the air directing means includes air deflector means extending in a curve conforming to but spaced from a portion of said guide surface immediately downstream from said deflector means.

* * * * *